United States Patent [19]

Perrault

[11] 4,233,782

[45] Nov. 18, 1980

[54] WORK CABINET FOR PODIATRISTS, DENTIST AND THE LIKE

[76] Inventor: Ronald Perrault, 3 avenue des Sapins, Notre-Dame des Prairies, Canada, J6E 1C3

[21] Appl. No.: 50,783

[22] Filed: Jun. 21, 1979

[51] Int. Cl.[3] ..... B24B 55/06

[52] U.S. Cl. ..... 51/5 R; 51/273

[58] Field of Search ..... 51/3, 5 R, 273; 144/252 R, 252 A; 424/137; 433/31, 92

[56] References Cited

U.S. PATENT DOCUMENTS

| | | | |
|---|---|---|---|
| 2,111,782 | 3/1938 | Hudson | 51/220 |
| 2,251,442 | 8/1941 | Emmons | 51/273 X |
| 2,324,019 | 7/1943 | Pfau | 51/273 |
| 2,470,601 | 5/1949 | Burke | 51/273 |
| 2,512,930 | 6/1950 | Gilmore | 51/273 |
| 2,576,008 | 11/1951 | Gladfelter | 51/273 X |
| 2,841,926 | 7/1958 | Lebus | 51/5 R |
| 3,098,332 | 7/1963 | Sutton | 51/273 X |
| 3,322,037 | 5/1967 | Cavagnero | 83/100 |
| 3,646,712 | 3/1972 | Quintana | 51/273 |
| 3,808,750 | 5/1974 | Mann | 51/273 |

*Primary Examiner*—Gary L. Smith

[57] ABSTRACT

A work cabinet it disclosed and intended to be located in the offices of podiatrists, dentists, prosthetic technicians, orthetic technicians, denturologists, jewellers and the like. The work cabinet provides a counter level table top below which are enclosed several air filtering and circulating units and on top of which are disposed side by side three housings, each provided with at least one front opening for having access to the working space within the respective housing. In a first housing are located power-driven tools for the rough machining and grinding operations to be effected on a work piece, such as a foot prothesis, foot-correcting inner sole, dentures, and the like small work pieces generally made of plastics, such as acrylics, porcelaine, plaster and the like. The second housing contains also power-driven tools, but mainly used for intermediate finishing operation, such as buffing and polishing of the same work pieces. The third housing is for the final polishing operation. Especially in the two first-named housings, a great quantity of particles and wet and dry dust are produced by the working operations. It is essential that said dust and particles be collected and filtered out without escaping into the outside atmosphere, since the cabinet is to be located in the user's office close to a patient. It is also essential that the working tools and the work piece held within the housings be illuminated for ease of working and due to the precision work involved, and that the light sources be kept clean at all time. Therefore, each housing is provided with air suction and filtering means and also with a jet of clean air directed onto the light source to prevent deposits of dust and particles thereon.

6 Claims, 6 Drawing Figures

WORK CABINET FOR PODIATRISTS, DENTIST AND THE LIKE

The present invention relates to a work cabinet of the portable type and intended to be located in the offices of podiatrists, dentists, prosthetic technicians, orthetic technicians, denturologists, jewellers and the like, for machining, grinding, buffing and polishing small work pieces, such as foot prothesis, foot-correcting inner soles, dental models and the like, which must be fashioned and finished in the office since they require several fittings on the patient during such working. Since this is a precision work, it is absolutely essential that the work piece and the working tool be well illuminated, thus requiring light sources located within the working space defined by a housing in which the working tool is located. The lights must be kept clean at all times, despite the great quantity of dry and wet dust and particles discharged by the working tool.

It is therefore the main object of the present invention to provide a work cabinet of the character described, provided with means for keeping clean at all time the light source exposed within the working space of the housing.

It is another object of the present invention to provide a work cabinet of the character described, including at least two separate housings, each with working tools and a working space for the insertion of a work piece, one housing being used for the rough work and the other housing being used for the finishing work.

Another object of the invention relates to a work cabinet of the character described, in which at least one of the housings is provided with a closed circuit air-circulating and purifying means, so arranged that the mass flow of air entering the cabinet is not greater than the mass flow of air sucked out of the housing, so as not to produce an over-pressure within the housing which might cause discharge of dust-laden air within the surrounding atmosphere.

In accordance with the invention, there is provided a housing having a work space to receive a work piece, a power-driven working tool located within the work space, the housing having a front opening providing working access to the work piece, a light source exposed within the work space and mounted within the top portion of the housing to illuminate the work piece and the working tool, an air suction mouth opening within said housing, air suction means communicating with said air suction mouth, means to filter the air evacuated from the housing by said air suction means, and an air discharge nozzle located in the housing and directed towards the light source to create an air stream of clean air over and around the light source and prevent the deposits of dust and dry and wet grindings on said light source, means to supply clean air under pressure to said nozzle, the arrangement being such that the mass flow of air discharged from the nozzle is not greater than the mass flow of air sucked out of said enclosure by said air suction mouth, so as not to produce an air over-pressure within the housing.

The foregoing and other objects of the present invention will become more apparent during the following disclosure and by referring to the drawings, in which.

Figure 1:
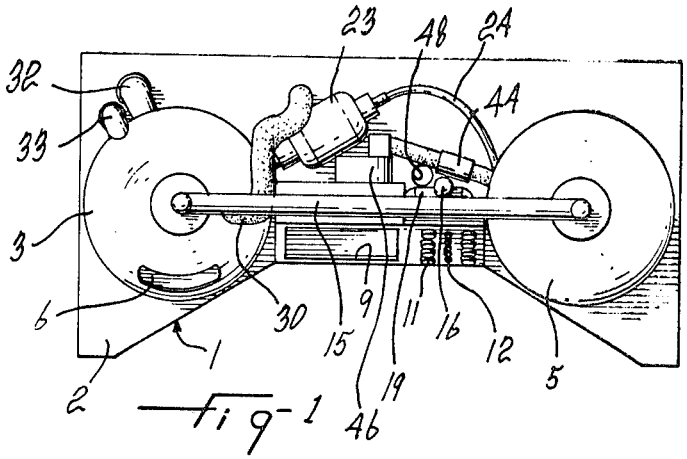
FIG. 1 is a top plan view of the work cabinet of the invention.
Figures 2, 3:
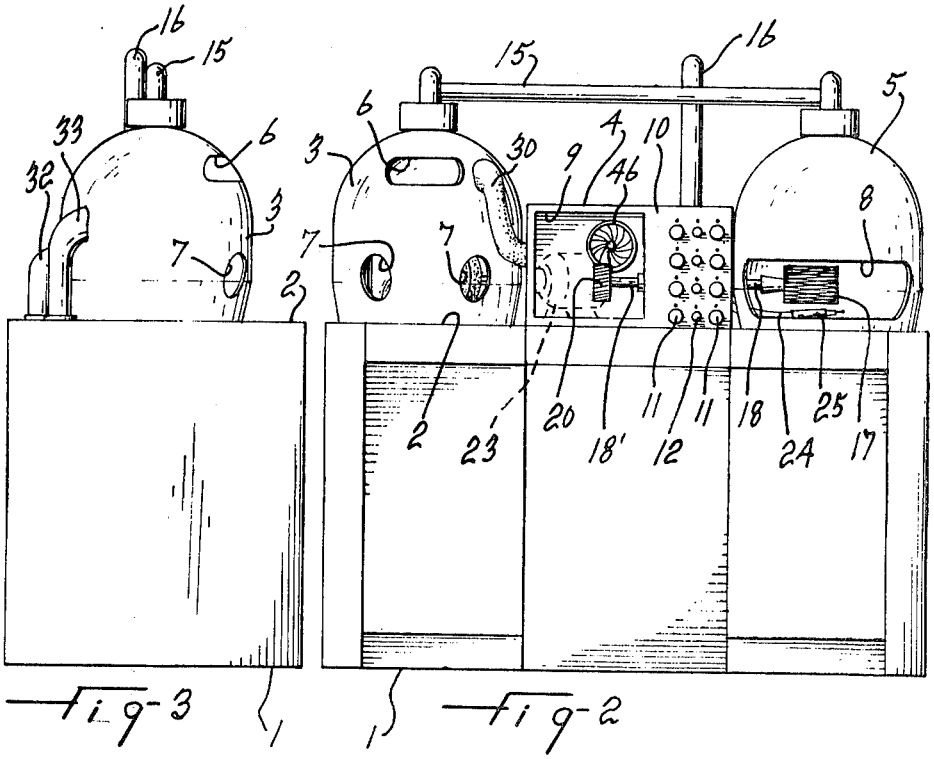
FIG. 2 is a front elevation of the work cabinet.
FIG. 3 is a left-hand elevation in relation to FIG. 2.
Figure 5:
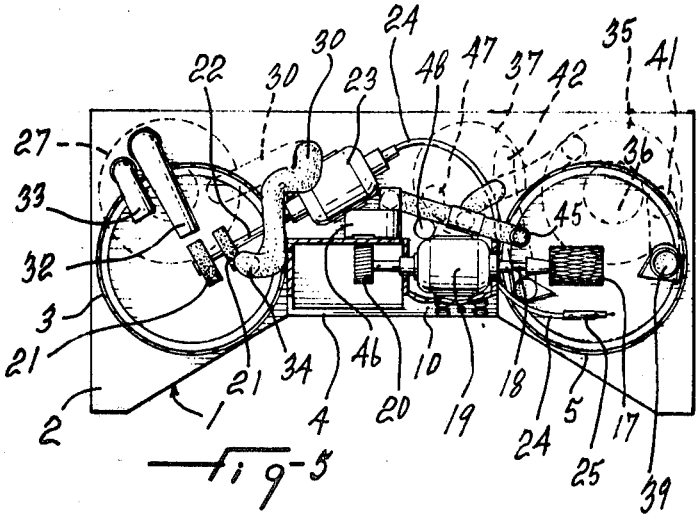
FIG. 5 is a plan section, taken along line 5—5 of FIG. 4.
Figure 6:
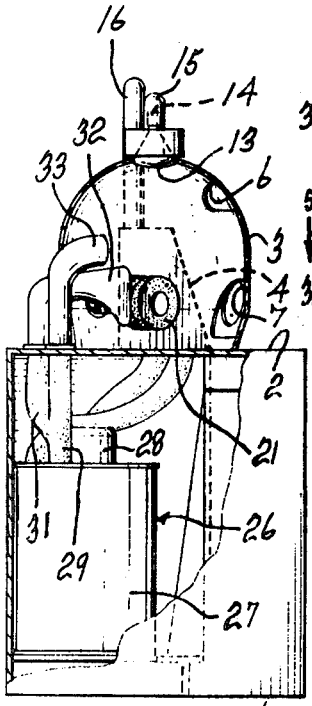
FIG. 6 is a partial section of the left-hand portion of the cabinet as shown in FIG. 4.
Figure 4:
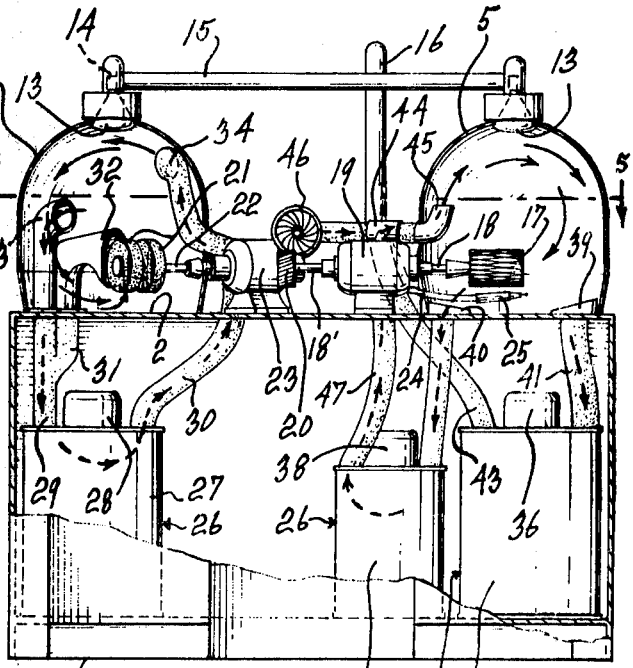
FIG. 4 is a vertical section, the central housing being removed.

Referring now more particularly to the drawings in which like reference characters indicate like elements throughout, the work cabinet comprises an article of furniture in the form of a counter, generally indicated at 1, having a counter level table top 2 on which are mounted side by side a first housing 3 on the left side of the counter 1 when facing said counter, a second housing 4 and a third housing 5. Housings 3 and 5 have a generally spherical shape and are made of shatter-proof material, preferably plastic material, such as polycarbonate. Housing 3 and 5 are transparent in their top half for seeing therethrough and white in their bottom half for better light reflection on the work piece and working tool. Housing 3 has a top opening 6 at the front thereof and two spaced circular front openings 7 located just above counter top 2. Top opening 6 is to view directly the inside of the housing 3 while openings 7 are for the insertion of the operator's hands inside the work space provided by the housing 3.

Housing 5 is provided with a large front opening 8, just above the table top 2, and to give access to the interior of the housing with the operator's hands, so that the latter can hold a work piece in working contact with the working tool inside the housing 5.

Housing 4, which is located intermediate housings 3 and 5, has simply a front opening 9 to give access to the interior thereof. This housing 4 may not be made of transparent material and is provided at its front closed face portion 10 with a series of buttons and controls, indicated at 11, and also with pilot lights, indicated at 12, corresponding to the buttons and said buttons used for controlling the operations of the motors of the various filter units and the motors driving the working tools, as will be described later on.

Each housing 3 and 5 is provided in its top portion with a light source, indicated at 13, to emit a diffused light all within the working space defined by the housings 3 and 5. The light source 13 is in the form of a conventional light bulb exposed within the work space of the respective housing. The light bulb 13 is screwed within a standard socket 14 mounted on top of the housing and the two sockets 14 are rigidly interconnected and supported by a horizontal tubular arm 15, in turn supported by a tubular post 16, fixed to and upstanding from the table top 2 of counter 1. Electrical wires connected to an electric supply, not shown, feed the electricity to the light bulbs 13.

At least one power-driven working tool is located and mounted in each of the housings 3, 4 and 5. Preferably, these working tools are rotary tools. Housing 5 is intended as a working space for rough shaping and working of a work piece and, consequently, the working tool, indicated at 17, may be a rotary cutter which can be replaced by a rotary sand grinder, or a router mounted on a shaft 18 of an electric motor 19 with the shaft 18 extending in fluid-proof manner through the wall of the housing 5. Electrical motor 19 is supported on the table top 2 and is not enclosed. The shaft 18' of the motor 19 extends from the opposite end of the motor housing and into the housing 4, which is used for the final finishing operations, such as buffing and polishing. Therefore, the shaft 18' of motor 19 carries, for instance as a working tool, a rotary polishing wheel 20. Shaft 18' extends through the housing 4 in fluid-tight manner.

Finally, housing 3 is intended for intermediate machining and finishing operation and the working tool is, for instance, a finer grinding wheel than the grinding wheel used in housing 5. Several sanding wheels of different degrees of fineness may be mounted, as indicated at 21, on the common rotary shaft 22 of an electric driving motor 23. Again, the electric motor 23 is located in the open outside the housing 3 and mounted on the table top 2 in the open atmosphere. Its shaft 22 extends through the wall of housing 3 in fluid-tight manner.

Motor 23 can also be used for driving through a flexible shaft 24. A hand-held fine work flexible rotary tool 25, which is used in the housing 5 for precision work on a work piece hand held in said housing 5. The work cabinet of the invention is intended to be installed, for instance, in the office of a podiatrist, next to the patient, since the podiatrist has to normally make several fittings onto the patient during working of the work piece, such as in foot prothesis and for a correcting inner sole. Therefore, it is essential that the wet and dry dust and particles produced during working be filtered out and not discharged into the atmosphere surrounding the work cabinet. Since this is precision working, the light bulbs 13 illuminating the working tools and the work piece must be kept free of any dust and wet and dry dust and particles at all time.

In accordance with the invention, there is provided a novel air circulation and filtering system for each of the housings 3, 4 and 5. For instance, foot prothesis and false inner soles are made either of cork, leather, acrylic plastic and the like and produce a lot of dust when worked out.

Housing 3 is provided with a closed circuit air circulation and filtering means including a conventional wet-dry filter device, generally at 26 and commonly found on the market. This device 26 comprises a tank 27 containing a filter, not shown, and an air circulating fan or ventilator power driven by electric motor 28 mounted on top of the tank 27. The tank has an air suction inlet connected to air suction hose 29 on top of the tank, and also on top of the tank a clean-air outlet connected to the clean-air outlet hose 30. The air circulating and filtering device 26 is located within the counter 1, below table top 2, and the hoses 29 and 30 extend through the table top 2. Air suction hose 29 has a Y connection 31 for connection to an air suction mouth 32 located within housing 5 adjacent the working tool 17 in housing 5. The Y connection 31 also connects a second air suction mouth 33 to the tank 27. Mouth 33 is located slightly above and rearwardly of mouth 32 to collect dust and particles which might have escaped mouth 32.

The clean air hose 30 is connected to an air nozzle 34, which is mounted inside housing 3 and is directed towards the light bulb 13, so as to constantly discharge a stream of clean air around and past the surface of the light bulb 13 to constantly keep the same free of wet or dry dust and particles. It will be noted that with respect to the housing 3, the same air mass flow enters and is sucked out of the housing in a closed air circulation, so that there will be no over-pressure produced in the housing 3 for escape of dust-laden air through the access openings 6 and 7. Counter 1 also houses two additional air circulating and filtering devices similar to device 26, namely tank 35 with its actuating motor 36 and tank 37 with its actuating motor 38. Tank 35 is of the same capacity as tank 27, while tank 37 is of smaller capacity. The housing 5 is provided at its bottom with two air suction mouths 39 and 40 disposed in the vicinity of the working tool 17 for collecting the dust and particles produced by said working tool. Mouth 39 is connected to the suction inlet of the tank 35 by air suction flexible hose 41, while mouth 40 is connected to tank 37 by air suction flexible hose 42. Housing 5, being used for rough machining and therefore producing more dust and particles than housing 3, this is the reason why the inlet of two devices 26 is connected to housing 5. The outlet of tank 35 is connected by outlet hose 43 through a T connection 44 and the clean air under pressure is supplied to nozzle 45 located within housing 5 and directed towards the light bulb 13 and surrounding area of housing 5 to always maintain the same free of any dust and particles due to the air stream passing around the same. The light bulb 13 always gives good illumination and the operator can clearly see through the wall of the housing while his face and eyes remain protected from flying debris. The nozzle 45 is further supplemented with additional air by an electric motor-operated turbine 46 having its inlet located in housing 4 and its outlet connected to the T connection 44. Turbine 46 therefore serves to suck and filter the air in the housing 4 used for the final finishing operation, the tool normally used therein being a polishing wheel of canvas coated with pumice. It has been found that lint produced by the canvas of the wheel and which is electrostatically charged, will deposit on the turbine blades and therefore this turbine also acts as a filter and will supply clean air to nozzle 45.

The outlet of the smaller capacity tank 37 is connected by outlet hose 47 to a nozzle 48 located close to electric motor 19 and, therefore, serving to supply clean air to said motor for cooling the same, since this motor is the one doing the most work for the rough working operation carried out in housing 5. The control knobs 11 are switches for controlling the operations of the various motors, namely motors 19, 23 and motor of turbine 46, together with motors 28, 36 and 38 of the filtering devices 26. Also, knobs 11 control the light bulbs 13.

The dentist, podiatrist or other professional or technician effects the rough machining of the work piece by inserting the same through the large opening 8 of housing 5, while looking through the top transparent portion of said housing swept clean by nozzle 45, and applying it to the working tool and using the pencil type rotary fine tool 25, if necessary. He can, from time to time, fit the work piece to the patient nearby, if necessary.

Once the rough machining is completed, he works the work piece in housing 3 by inserting his hands through the circular openings 7 and looking through the top opening 6 and the final polishing operation is carried out in housing 4 which is preferably illuminated by a light source (not shown). In housing 5, it will be noted that, since the turbine 46, which supplies air to nozzle 45, is of smaller capacity than filtering tank 37, and since the air suction inlets of both tanks 35 and 37 are connected to housing 5, there will be an air depression within housing 5, further preventing any escape of dust or particles to the outside through large opening 8.

What I claim is:

1. A work cabinet for machining, grinding, buffing and polishing small work pieces, such as dental models, foot protheses, foot-correcting inner soles and the like, said work cabinet comprising a housing having a work space to receive a work piece and having a front opening providing working access to said work piece, a power-driven working tool located in said working space, a light source exposed in said working space and mounted within the top portion of said housing to illuminate the work piece and the working tool, an air suction mouth opening in said housing adjacent said working tool, air suction means communicating with said air suction mouth, means to filter the air evacuated from said housing by said air suction means, a clean air-discharging nozzle located in said housing and directed towards said light source to create an air stream of clean air over and around said light source and to prevent deposits of dry and wet dust and grindings on said light source, means to supply clean air under pressure to said nozzle, the mass flow of air discharged by said nozzle not being greater than the mass flow of air sucked out of said housing by said air suction means, so as not to produce an air over-pressure within said housing.

2. A work cabinet as claimed in claim 1, wherein said air suction means, said air-filtering means and said means to supply clean air under pressure to said nozzle, are arranged in a closed air-circulating circuit with said housing, so that the mass flow of clean air discharged by said nozzle is substantially equal to the mass flow of air sucked out of said housing by said air suction means.

3. A work cabinet as claimed in claim 1, wherein said air suction means has a greater capacity than said means to supply clean air under pressure to said nozzle, whereby the mass flow of air discharged by said nozzle is less than the mass flow of air sucked out of said enclosure by said air suction means, so as to produce an air under pressure within said housing.

4. A work cabinet as claimed in claim 1, 2 or 3, wherein said housing is made of transparent material and said front opening is located at the level of the operator's hands standing up in front of said housing, said transparent housing enabling the operator to see the work piece and the working tool through the wall of said housing, in a portion thereof adjacent said light source and swept by said clean air discharged from said nozzle.

5. A work cabinet as claimed in claim 2, further including a second housing disposed side by said with respect to the first-named housing, said second housing being made of transparent material and having a front opening at the lower portion thereof at a level for the insertion of the hands of an operator standing in front of said housing for providing working access to a work piece hand held in said housing, a power-driven working tool located in said second housing, a light source exposed in the work space of said second housing and mounted within the top portion of said second housing to illuminate the work piece and the working tool therein, a second air suction mouth opening in said second housing, second air suction means communicating with said second air suction mouth, second means to filter the air evacuated from said second housing by said second air suction means, a second air-discharging nozzle located in said second housing and directed towards said second light source to create an air stream of clean air over and around said light source and over the top portion of said transparent housing to prevent deposits of dry and wet dust and grindings on said light source and over said adjacent portion of said transparent housing, second means to supply clean air under pressure to said second nozzle, said second air suction means having a greater capacity than the capacity of said second means to supply clean air under pressure to said second nozzle, whereby the mass flow of air discharged by said second nozzle is less than the mass flow of air sucked out of said second housing by said second air suction means, so as to produce slight air under pressure within said second housing, the working tool in said second housing serving for rough working of said work piece and the working tool in said first housing serving for finer working of the same work piece.

6. A work cabinet as claimed in claim 5, further including a third housing arranged side by side with said first and second housings, a power-driven work polishing tool located in said housing, said third housing having a front opening for working access to a work piece held in said third housing against said last-named working tool, a power driven air suction turbine communicating with said third housing and discharging the air evacuated from said third housing directly into said second housing.

* * * * *